United States Patent [19]

Lubojatzki

[11] Patent Number: 4,511,290

[45] Date of Patent: Apr. 16, 1985

[54] SUPPORT FRAME FOR UNDERGROUND MINING OPERATIONS

[75] Inventor: Walter Lubojatzki, Recklinghausen, Fed. Rep. of Germany

[73] Assignee: Klöckner-Becorit GmbH, Castrop-Rauxel, Fed. Rep. of Germany

[21] Appl. No.: 377,356

[22] Filed: May 12, 1982

[30] Foreign Application Priority Data

May 13, 1981 [DE] Fed. Rep. of Germany ..... 3118939

[51] Int. Cl.[3] ..... E21D 15/44

[52] U.S. Cl. ..... 405/292; 405/296

[58] Field of Search ..... 405/291, 292, 296, 297, 405/299

[56] References Cited

U.S. PATENT DOCUMENTS

| | | | |
|---|---|---|---|
| 4,027,489 | 6/1977 | Walker et al. | 405/296 |
| 4,118,939 | 10/1978 | Saunders | 405/297 X |

FOREIGN PATENT DOCUMENTS

| | | | |
|---|---|---|---|
| 1264370 | 3/1968 | Fed. Rep. of Germany | 405/292 |
| 783480 | 11/1980 | U.S.S.R. | 405/296 |
| 819351 | 4/1981 | U.S.S.R. | 405/296 |
| 819356 | 4/1981 | U.S.S.R. | 405/296 |

*Primary Examiner*—David H. Corbin

*Attorney, Agent, or Firm*—Collard, Roe & Galgano

[57] ABSTRACT

The invention relates to a structural frame for mining operations wherein at least one stabilization element is provided and coupled between the roof of the seam cap and the floor of the seam support base which is pivotable around a pivot axis extending in the longitudinal direction of the truss. In order to prevent damage to the stabilization element or the pivot axis during occuring mountain forces, the stabilization element and/or the guides or links guiding the same are designed as yielding spring elements yieldable against compression and tension forces whose restoring forces are dimensioned so large that the parts which have been released from the bracing between the roof of the seam and the floor of the seam can be adjusted back into the initial position by the effect of the restoring forces.

4 Claims, 3 Drawing Figures

SUPPORT FRAME FOR UNDERGROUND MINING OPERATIONS

Figure 1:
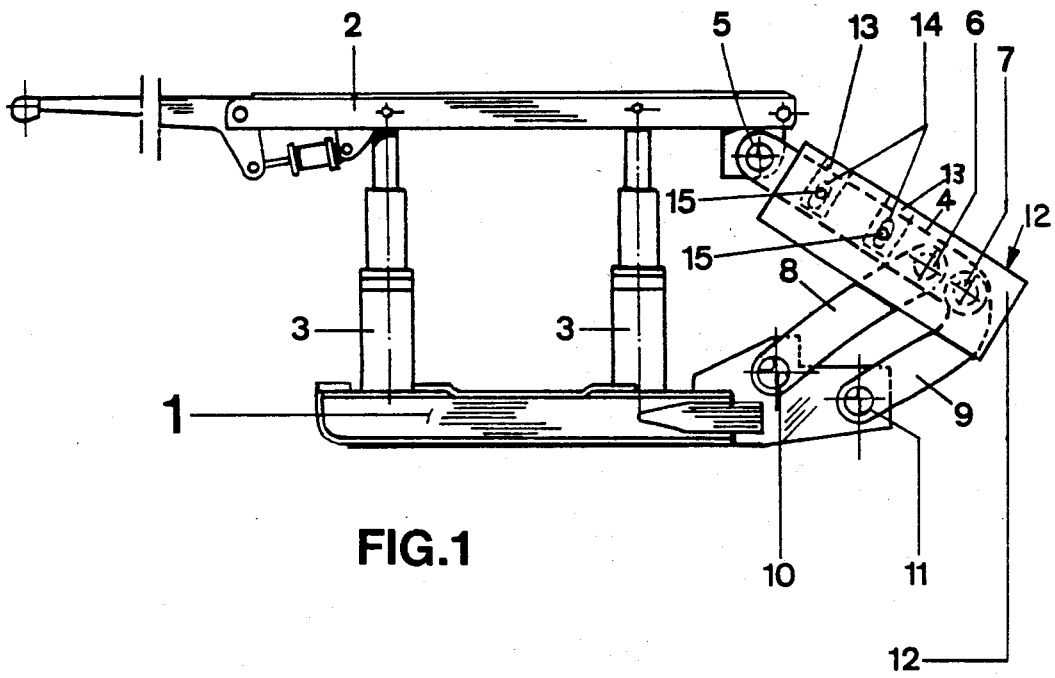

The invention relates to a support frame for serving as a face support in underground mining operations. More particularly, it relates to such a support frame provided with a floor of the seam support base supported on the floor of the seam and a roof of the seam cap supporting the roof of the seam which are braceable between the roof of the seam and the floor of the seam by at least one hydraulic jack and wherein at least one stabilizing swing or element is provided and coupled between the floor of the seam support base and the roof of the seam cap which is pivotable in the longitudinal direction of the truss.

In accordance with the type of above-mentioned support frames, there are included, shield or plate support frames (for example, German Auslegeschrift No. 24 03 834), wherein the scrap or rubble shield has the function of the swingable stabilization element, as well as support frames (German Auslegeschrift No. 27 21 381) wherein a separate stabilization element is provided between the roof of the seam cap and the floor of the seam support base.

The basic feature of the support frames of the inventive type is that the upper end of the stabilization element or the roof of the seam cap mounted thereon are guided along a predetermined path relative to the floor of the seam support base or pad when lowering the roof of the seam cap, whereby the geometric shape depends on the design of the joint or pivotable connection between the stabilization element and the floor of the seam guide. Therefore, the joint in shield or plate support frames between the floor of the seam support base and the stabilization element are very often designed as a parallelogram linkage in such a manner that the tip of the stabilization element moves along a longitudinally extending S-shaped lemniscate during the lowering movement which conforms to about a vertical line. However, even with the so-called "lemniscate guiding", it is unavoidable that, during the compression of the support frame caused by the influence of mountain pressure, bank-parallel relative movements occur between the roof of the seam cap and the roof of the seam and between the floor of the seam support base and the floor of the seam. Such relative movement can only be avoided if the kinematic movement of the point of the stabilization element, which is forced by the guide, coincides with the direction of movement of the roof of the seam, which, in practice, never occurs.

The aforementioned bank parallel displacements between the roof of the seam and the roof of the seam cap and the floor of the seam and the floor of the seam support base naturally cause large, bank parallel force components which have to be relieved by the stabilization element or whose displacement must be accommodated at the floor of the seam support base and the roof of the seam cap. Therefore, in practice, these structural parts are designed to be very sturdy. In the static calculation of these structural parts, a coefficient of friction between steel and stone of $\mu=0.3$ is calculated. This means that these structural parts have to be so designed that they can absorb bank parallel force components which correspond to about 0.3 times of the face support resistance. Higher friction coefficients or, in the worst case, a positive locking at the edges or unevenness of the roof of the seam or the floor of the seam result in overloading and destruction of the structural parts, even with such a sturdy type of construction.

In accordance with the state of the art, (German Auslegeschrift No. 27 21 381) it is known to balance the bank parallel displacements in the area of the mounting of the stabilization element at the roof of the seam cap in such a manner that the pivot axis which extends in the longitudinal direction of the truss is displaceably mounted in the longitudinal direction of the roof of the seam cap in a sliding guide bearing. However, on the one hand, it means that there is a high cost with respect to the bearing technology and an additional wear and, on the other hand, it requires the use of additional restoring elements in the form of hydraulic pressure cylinders, or the like, by which the pivot axis is displaced back into the initial position after an occurring displacement before the renewed bracing of the support frame.

In accordance with the state of the art, (German Patentschrift No. 23 09 671; German Offenlegungsschrift No. 23 20 960; German Auslegeschrift No. 24 03 834; and German Auslegeschrift No. 27 21 381) it is further known to provide between the upper end of the stabilization element and the roof of the seam cap a further joint with a pivot axis running in the direction of the longitudinal axis of the roof of the seam cap, or, alternately, ball joint, in addition to the joint with a pivot axis extending in the direction of longitudinal axis of the truss. This additional flexibility permits an inclination of the roof of the seam cap about an axis extending in the longitudinal direction of the roof of the seam cap, so as to conform to any prevalent corrugations or undulations in the roof of the seam, but does not solve the problems caused by the unavoidable bank parallel displacements between the roof of the seam and the roof of the seam cap and the floor of the seam and the floor of the seam support pad. Furthermore, relatively expensive restoring means are required for returning the roof of the seam cap back into its initial position after releasing it from its bracing position.

It is an object of the invention to improve the face support in accordance with the type mentioned by using simple technical measures, so that the roof of the seam cap can follow the lowering movements of the roof of the seam, is able to incline in any given direction and returns automatically into the initial position during release from the tensioning between the roof of the seam and the floor of the seam depending on the predetermined geometry of the guide system.

This object of the invention is attained according to the invention by the provision of a support for one of the aforementioned types, wherein the stabilization element and/or the guides or links guiding the same are designed as spring elements yieldable against compression and tension forces whose restoring forces are dimensioned so large that the parts which have been released from the bracing between the roof of the seam and the floor of the seam can be returned to their initial position by the effect of the restoring forces.

In the support frame in accordance with the invention, the balance of the bank parallel displacements during the compression of the support frame is absorbed within the elastic yielding elements containing the stabilizing and guide systems by means of a corresponding elastic or yielding deformation of the yielding components, so that the feared excessive load conditions may not occur. Due to the elasticity with respect to the torsion forces, the roof of the seam cap can also incline in the longitudinal direction, if need be, which is balanced by a corresponding torsion of the spring elements in the spring elements of the stabilization and guide systems. However, these displacements are only possible when corresponding large forces are transmitted by the roof of the seam to the support frame. However, if the support frame is relieved from the brace between the roof of the seam and the floor of the seam, the relatively strong restoring forces are able to move the parts of the support frame back into the initial position by means of the predetermined geometry of the guide system.

For realization of the invention, the stabilization elements or swings and/or the guides or links have to be designed as spring elements by means of a corresponding material selection, shape and dimensioning. Thereby, neither additional bearing elements nor restoring means, or the like, have to be used. Therefore, the total structure has the simple and robust structure which is required for use in mining.

Advantageously, the stabilization element or swing and/or the control guides or links of the same consist of one or a plurality of leaf springs which are disposed parallel relative to each other in a spaced-apart manner and parallel to the pivot plane of the stabilization element. Such structured spring elements which consist, optionally, of parallel leaf springs which are disposed parallel with respect to each other which, on the one hand, are torsionable and yieldable to the required extent against compression forces in the required amount but are still relatively bend-resistant with respect to the pivot plane which is important for the guide function of these parts when the support frame is relieved from the bracing.

Preferably, two or a plurality of stabilization elements are provided, in particular, adjacent to each other. Thereby, it is possible to distribute the guide forces at an optimum to the support frame, so that one may use only particularly weak-dimensioned stabilizing elements.

In a particular preferred embodiment of the invention, a support frame with a stabilization element is provided at the "mine filling" side, i.e., in a shield support frame, a protective shield against the mine filling is mounted on the stabilization element or elements, whereby the mounting means affords the required free play for the deformation of the stabilization element between the stabilization element and the mine filling protective shield. In such a structured support frame, the function of the guiding of the roof of the seam cap, on the one hand, and the screening against the mountain rubble are separated from each other, in contrast to the known shield face supports which usually fulfill such functions, in that the guiding function is taken care of by the stabilization elements alone and the screening function is taken care of by the protective shield, so that both parts can be disposed of separately. This was necessary because the protective shield must be very stable due to the forces affecting it, while the stabilization element must be yielding, at least with respect to the torsion forces and the compression forces.

In accordance with a further embodiment of the invention, the mounting of the mine filling protective shield on the stabilization elements is advantageously carried out by mounting straps with longitudinal openings associated with the mine filling protective shield, whereby bolts associated with the stabilization elements engage into the longitudinal openings with a free play at all sides. In this manner, a sufficient and simple secure connection between the stabilization element or elements is obtained, on the one hand, and the mine filling protective shield, on the other hand, thus leaving the required free play for the elastic deformability for the stabilization elements.

Other objects and features of the present invention will become apparent from the following detailed description of the drawing, which discloses one embodiment of the invention. It is to be understood that the drawing is to be used for the purposes of illustration only, and not as a definition of the limits of the invention.

Figure 2:
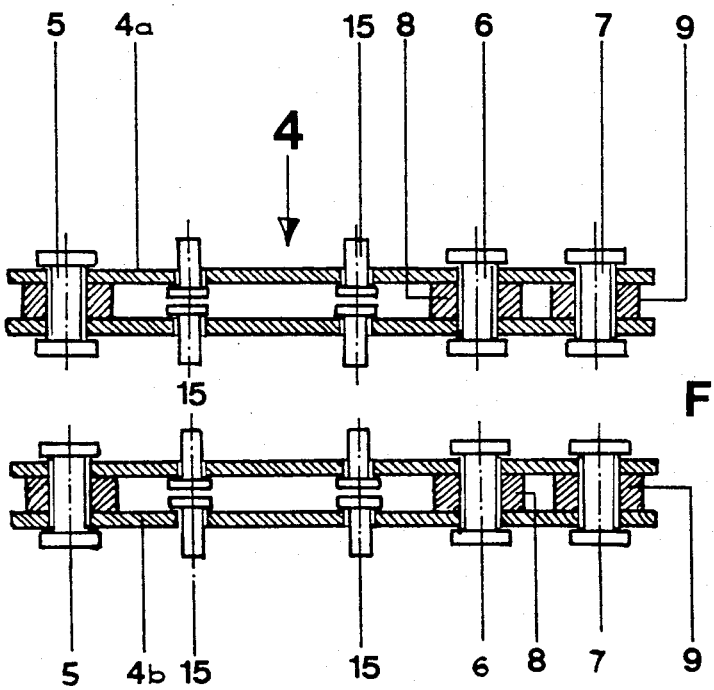
Figure 3:
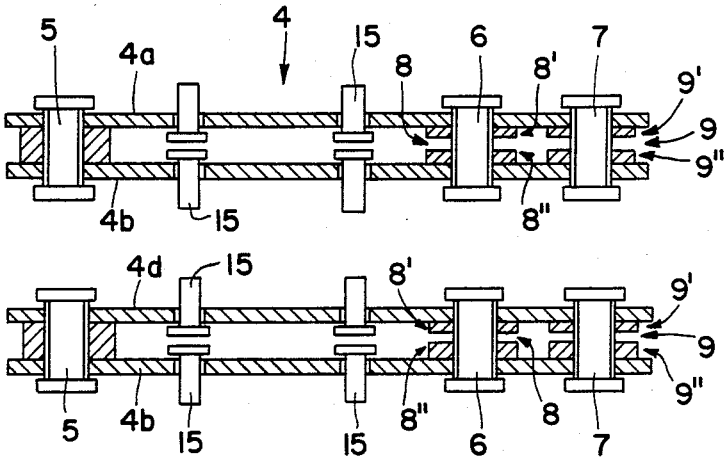

In the drawing, wherein similar reference characters denote similar elements throughout the several views:

FIG. 1 is a side elevational view of a structural frame in accordance with the invention; and FIG. 2 is a longitudinal sectional view through the two stabilizing swing elements of the frame illustrated in FIG. 1. and FIG. 3 is a comparable view to that of FIG. 2, but illustrating an alternate embodiment of the guides whereby they comprise a plurality of spaced-apart leaf springs.

Referring now in detail to the drawing, the structural frame includes a floor of the support pad or base 1 which is supported on the floor of the seam and a suspended roof of the seam cap 2 which supports the roof of the seam. Hydraulic jacks or posts 3 are provided between the floor of the seam support base 1 and the roof of the seam cap 2, which are coupled to the floor of the seam guide 1, as well as to the roof of the seam cap 2, in a universal joint manner, which is not shown in detail, thus acting to brace the structural frame between the roof of the seam and the floor of the seam.

The floor of the seam support base 1 and the roof of the seam cap 2 are connected with each other by guide and stabilization elements. In particular, they are provided with two parallel, oscillatable, rocking or swinging stabilization elements or balancers 4, the upper ends of which are mounted at the mining end of the roof of the seam cap 2 by means of pin or bolt joints 5 having a pivot axis extending in the longitudinal direction of the truss. The lower ends of the stabilization elements 4 are connected with guides or links 8 and 9 connected by means of pin or bolt joints 6 and 7, which, in turn, are connected with the mine end of the floor of the seam support base 1 by means of pin or bolt joints 10 and 11, respectively. In this manner, the two guides 8 and 9, the lower section of the stabilization elements 4 and the mining end of the floor of the seam support base 1 form a parallelogram linkage at whose corners the bolt joints 6, 7, 10 and 11 are provided, with pivot axes extending in the longitudinal direction of the truss, and by which the stabilization element 4 is guided in such a manner that its upper end, and thereby the roof of the seam cap 2 mounted thereon, are guided along a longitudinally-extending lemniscate during the lowering relative to the floor of the seam support base 1 which conforms closely to a vertical straight line.

In accordance with the invention, the stabilization elements 4 are yieldably or resiliently designed with respect to torsion forces, as well as compression forces. For this purpose, the stabilization elements 4 consist of two spaced-apart leaf springs **4*a* and 4*b* which are made of relatively thin spring steel and which extend in planes parallel to the pivot plane of the stabilization element. When compression forces are created, the leaf springs 4*a* and 4*b* can laterally bend inwardly or outwardly, thus yielding to the compression forces. Furthermore, they can rotate around its longitudinal axis, thus yielding to torsion forces. Despite this, the leaf springs 4***a* and 4*b* are relatively bend-resistant in the pivot plane of the stabilization element 4.

The leaf springs 4*a* and 4*b* are so designed that the restoring forces generated by the deformation are so large that the parts of the structural frame which were released from the tension between the roof of the seam and the floor of the seam are moved back into their initial position by means of these restoring forces.

Furthermore, a mine screening plate or shield 12 is mounted on the stabilization element 4 which is provided with mounting flanges or straps 13 with associated elongated openings 14 in which are received, with a free play at all sides, mounting pins or bolts 15 which are connected with leaf springs 4*a* or 4*b*. This free play clearance is dimensioned so large that the wanted and permissible deformation of the stabilizing element 4 is not interfered with by the mining protective shield 12.

In the exemplified embodiment shown in the drawing, two stabilizing elements or balancers 4 are provided between the floor of the seam support base 1 and the roof of the seam cap 2. Deviating therefrom, only one stabilizing element 4 would suffice. If need be, three or more of the stabilizing elements may be used which may then be designed somewhat weaker. If need be, the stabilization elements 4 may also be successively disposed in moving direction with respect to each other in the structural frame.

In the exemplified embodiment illustrated in the drawing, the stabilization elements 4 further consist of two leaf springs 4*a* and 4*b*. However, deviating therefrom the stabilizing elements may consist of a single leaf spring or more than two parallel spaced-apart leaf springs.

Finally, as shown in FIG. 3, the guides 8 and 9 for the stabilization elements 4 may be designed as spring elements and may also consist of one or a plurality of leaf springs 8' and 8'' and 9' and 9'', respectively, spaced apart from each other in the same manner as the stablilization element 4.

While only one embodiment of the present invention has been shown and described, it is obvious that many changes and modifications may be made thereunto without departing frm the spirit and scope of the invention.

What is claimed is:

1. A support frame for serving as a face support in mining operations comprising:

a floor of a seam support supportable on the floor of the seam;

a roof of the seam support for supporting the roof of the seam;

at least one hydraulic strut coupling said seam support floor and said seam support roof and serving to brace the same between the roof of the seam and the floor of the seam; and at least one stabilization element and guide therefor pivotably coupled and disposed between said seam support floor and said seam support roof pivotable in the longitudinal direction of the support frame to define a pivot plane, at least one of said stabilization element and said guide comprising a plurality of parallel, spaced-apart planar leaf springs, the planar surfaces of which are disposed parallel to said pivot plane, which are resistant to bending in said pivot plane and resilient to compressive and torsion forces, said leaf springs having restoring forces great enough to return the roof of the seam support to its initial position upon release from the bracing between the roof of the seam and the floor of the seam.

2. The support frame of claim 1, wherein at least two of said stabilization elements are provided adjacent to each other between said seam support and said seam support roof.

3. The support frame of claim 1, additionally including a mine filling protective shield mounted on said stabilization element via mounting means, said mounting means providing sufficient free play for the deformation of the stabilization element between the stabilization element and said shield.

4. The support frame of claim 3, wherein said mounting means comprises mounting straps having longitudinally-extending openings coupled to said shield and bolts coupled to said stabilization element which are received within said longitudinally-extending openings with a free play at all sides.

* * * * *